US010117509B1

(12) United States Patent
Cooke

(10) Patent No.: US 10,117,509 B1
(45) Date of Patent: Nov. 6, 2018

(54) PORTABLE TABLE ASSEMBLY WITH STABILIZING MEMBERS

(71) Applicant: Steven Cooke, Franklin, TN (US)

(72) Inventor: Steven Cooke, Franklin, TN (US)

( * ) Notice: Subject to any disclaimer, the term of this patent is extended or adjusted under 35 U.S.C. 154(b) by 0 days.

(21) Appl. No.: 15/635,422

(22) Filed: Jun. 28, 2017

Related U.S. Application Data

(60) Provisional application No. 62/355,517, filed on Jun. 28, 2016.

(51) Int. Cl.
*A47B 3/08* (2006.01)
*A47B 96/20* (2006.01)

(52) U.S. Cl.
CPC ..... *A47B 3/0818* (2013.01); *A47B 96/20* (2013.01)

(58) Field of Classification Search
CPC ..... A47B 3/0818; A47B 96/20
USPC ..... 108/9, 90, 115, 17, 14, 11, 35, 60, 27, 108/13, 15, 18
See application file for complete search history.

(56) References Cited

U.S. PATENT DOCUMENTS 696,462 A * 4/1902 Markstrom ..... A47B 88/00 108/13
1,038,974 A * 9/1912 Schulz ..... A47B 85/08 312/240
1,345,444 A * 7/1920 Horvitz ..... A47B 17/04 108/60
1,872,849 A * 8/1932 Townes ..... A47B 23/00 108/26
1,929,551 A * 10/1933 Hamilton ..... A47B 39/00 108/13
2,244,036 A * 6/1941 Williman ..... A47B 27/02 108/11
2,598,128 A * 5/1952 Liechty ..... A47B 19/08 108/127
2,604,373 A * 7/1952 Beriou ..... A47B 69/00 108/13
3,211,506 A * 10/1965 Levy ..... A47B 19/00 312/196
3,361,090 A * 1/1968 Howlett ..... A47B 17/00 108/125
3,588,210 A * 6/1971 Des Marais ..... A47B 41/00 108/60
3,620,587 A * 11/1971 Ahmann ..... A47B 13/00 312/203
6,161,486 A 12/2000 Boots
6,164,211 A * 12/2000 Faris ..... A47B 85/06 108/11

(Continued)

*Primary Examiner* — Jose V Chen
(74) *Attorney, Agent, or Firm* — Patterson Intellectual Property Law, PC; Gary L. Montle

(57) ABSTRACT

A table assembly may include a tabletop member having a lateral sidewall and a longitudinal sidewall. A cover may be pivotally connected to the tabletop member about a cover pivot. The cover may be configured to move from a closed position to a display position and may include a cover cavity having an interior wall. An adjustable length arm may include a first arm portion and a second arm portion. The first arm portion may be pivotally connected to the lateral sidewall of the tabletop member. The second arm portion may be pivotally connected to the interior wall of the cover. The cover may be configured to receive the tabletop member in the cover cavity when the cover is in the closed position. The cover pivot may be located nearer the longitudinal sidewall of the tabletop member than the first arm end portion.

11 Claims, 6 Drawing Sheets

(56) References Cited

U.S. PATENT DOCUMENTS

| | | | | |
|---|---|---|---|---|
| 6,253,688 | B1 | 7/2001 | Lor | |
| 6,308,641 | B1 * | 10/2001 | Kingbury | A47B 5/04 108/42 |
| 6,315,252 | B1 * | 11/2001 | Schultz | B60R 11/0252 108/44 |
| 6,354,227 | B1 * | 3/2002 | Feldpausch | A47B 37/02 108/10 |
| 6,412,424 | B1 * | 7/2002 | Dirks | B60N 3/001 108/44 |
| 7,628,439 | B1 | 12/2009 | Strong | |
| 7,789,025 | B2 * | 9/2010 | Michaud, II | A47B 17/02 108/147 |
| 8,381,661 | B2 * | 2/2013 | Hilde | A47B 43/00 108/42 |
| 9,381,605 | B2 * | 7/2016 | Moyer | B23Q 3/18 |
| 2003/0172493 | A1 | 9/2003 | Christiansen et al. | |
| 2006/0238090 | A1 | 10/2006 | Jordan | |
| 2011/0203490 | A1 * | 8/2011 | Carter | B25H 1/02 108/26 |
| 2014/0305977 | A1 | 10/2014 | Sparks | |
| 2014/0373759 | A1 | 12/2014 | Rumeau | |
| 2015/0238007 | A1 * | 8/2015 | Faller | A47B 3/0912 108/14 |

* cited by examiner

PORTABLE TABLE ASSEMBLY WITH STABILIZING MEMBERS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 62/355,517, filed Jun. 28, 2016, and which is hereby incorporated by reference in its entirety.

BACKGROUND

The present disclosure relates generally to a table assembly. More particularly, the present disclosure pertains to a table assembly with a cover configured to move from a closed position to a display position and vice versa.

Tailgating is a popular pastime in the United States. Typically, a group congregates around vehicles in a parking lot to celebrate and cheer for their favorite sports team. The food and other necessary supplies are usually transported in a trunk of a vehicle or bed of a truck. Some truck owners use the rear of the truck as a table by letting down the truck's tailgate. Other tables, such as a typical card table, may also be used.

These festivities typically require space for backing up a truck or other vehicle to be used as a serving platform. Using a typical card table without a vehicle may not feel as authentic as typical tailgating to an attendee.

What is needed, therefore, is a table assembly that allows for a more authentic feel of tailgating even when a vehicle is not present when compared to a typical card table or picnic table.

BRIEF SUMMARY

Briefly, the present disclosure relates, in one embodiment, to a table assembly. The table assembly may include a tabletop member. The tabletop member may include a lateral sidewall and a longitudinal sidewall.

The table assembly may also include a cover. The cover may be pivotally connected to the tabletop member about a cover pivot. The cover may be configured to move from a closed position to a display position.

The cover may also include a cover cavity. The cover cavity may have an interior wall.

The table assembly may further include an adjustable length arm. The adjustable length arm may include a first arm portion and a second arm portion. The first arm portion may be pivotally connected to the lateral sidewall of the tabletop member. The second arm portion may be pivotally connected to the interior wall of the cover.

The cover may be configured to receive the tabletop member in the cover cavity when the cover is in the closed position.

The cover pivot may be located nearer the longitudinal sidewall of the tabletop member than the first arm end portion.

The cover pivot may further include a pivot rod.

The cover may further include a cover support plate disposed on the interior wall. The cover support plate may be configured to receive the pivot rod.

The first arm end portion may be pivotally connected to the cover support plate.

A spacer may be disposed between the lateral sidewall of the tabletop member and the interior wall of the cover. The spacer may be configured to maintain a space between the lateral sidewall and the interior wall. The adjustable length arm may be disposed in the space when the cover is in the closed position.

The spacer may be disposed about the pivot rod.

The tabletop member may further include a second arm end portion support plate. The second arm end portion may be pivotally connected to the second arm end portion support plate.

A lock may be configured to secure the cover to the tabletop member when the cover is in the closed position.

The lock may include a deadbolt configured to extend into the interior wall of the cover.

The deadbolt may be further configured to extend through the lateral sidewall of the tabletop member.

The longitudinal sidewall of the tabletop member may be disposed in the cover cavity both when the cover is in the closed position and when the cover is in the display position.

The tabletop member may further include a tabletop member underside. The tabletop member underside may face away from the cover member when the cover member is in the closed position. The tabletop member may also include a plate disposed on the tabletop member underside.

The plate may be configured to provide extra weight to the tabletop member such that the table assembly resists toppling when the cover is in the display position.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, one or more sections of hooks and corresponding one or more sections of loops, ribbons, laces, ropes, buttons, and the like allowing for a stationary, translatable, or pivotal relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotal fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, textiles, leathers, or any combination thereof.

Figure 1:
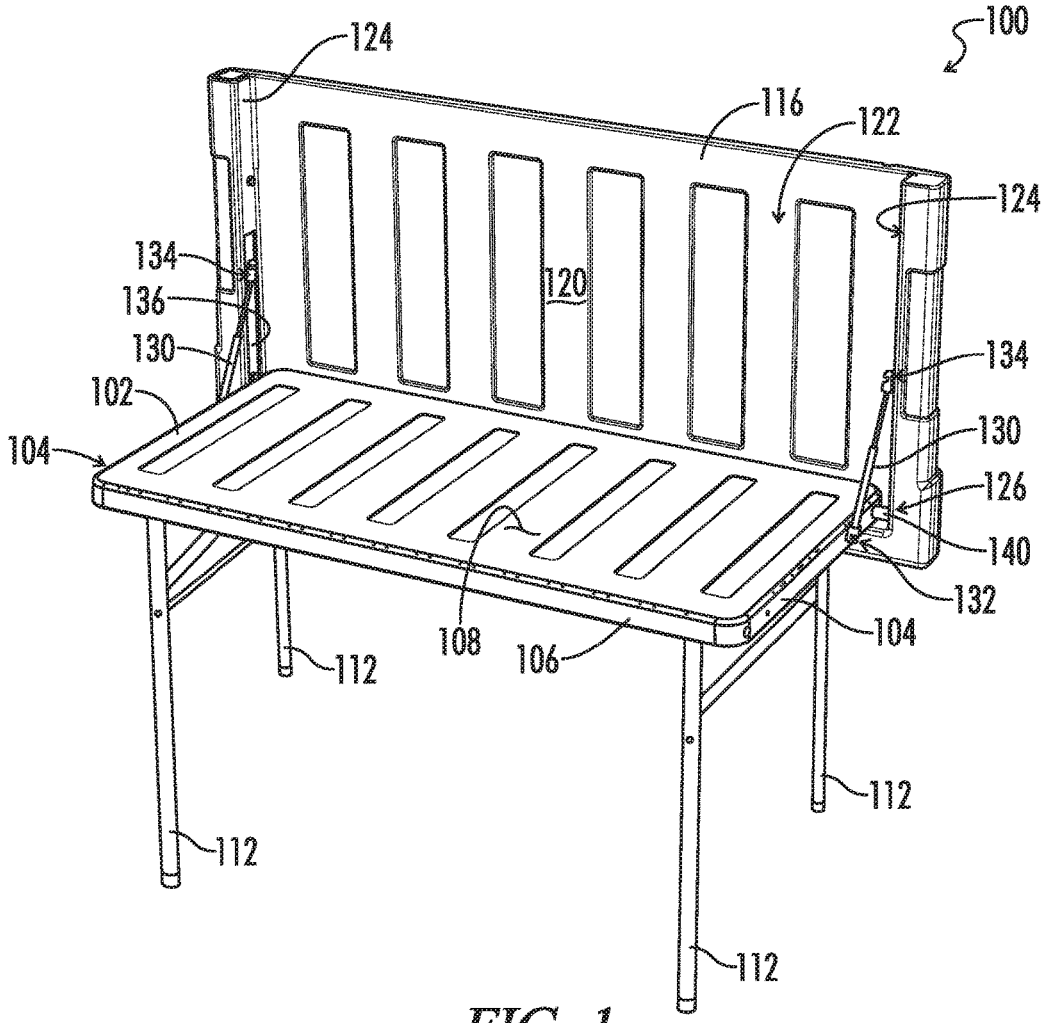
FIG. 1 is a perspective view of one embodiment of the table assembly with the cover in the display position and the legs deployed.

Referring to FIG. 1, a table assembly 100 is shown. The table assembly 100 may include a tabletop member 102. The tabletop member 102 may include a lateral sidewall 104 and a longitudinal sidewall 106. The tabletop member 102 may be any appropriate shape, but is shown as a rectangular tabletop member. As shown, the tabletop member 102 may include two opposing lateral sidewalls 104 and two opposing longitudinal sidewalls 106. The tabletop member 102 may further include a top surface 108 and an underside 110 (shown in FIG. 5).

Figure 2:
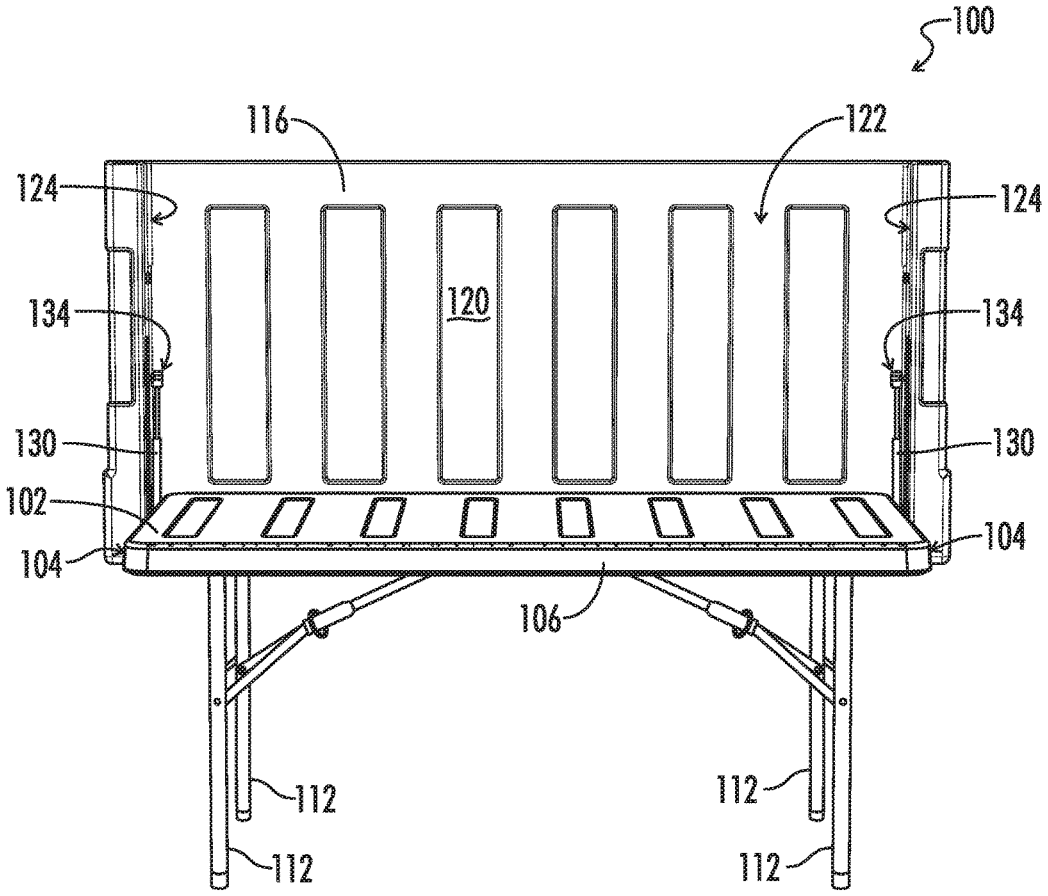
FIG. 2 is a front elevation view of the table assembly of FIG. 1.
Figure 3:
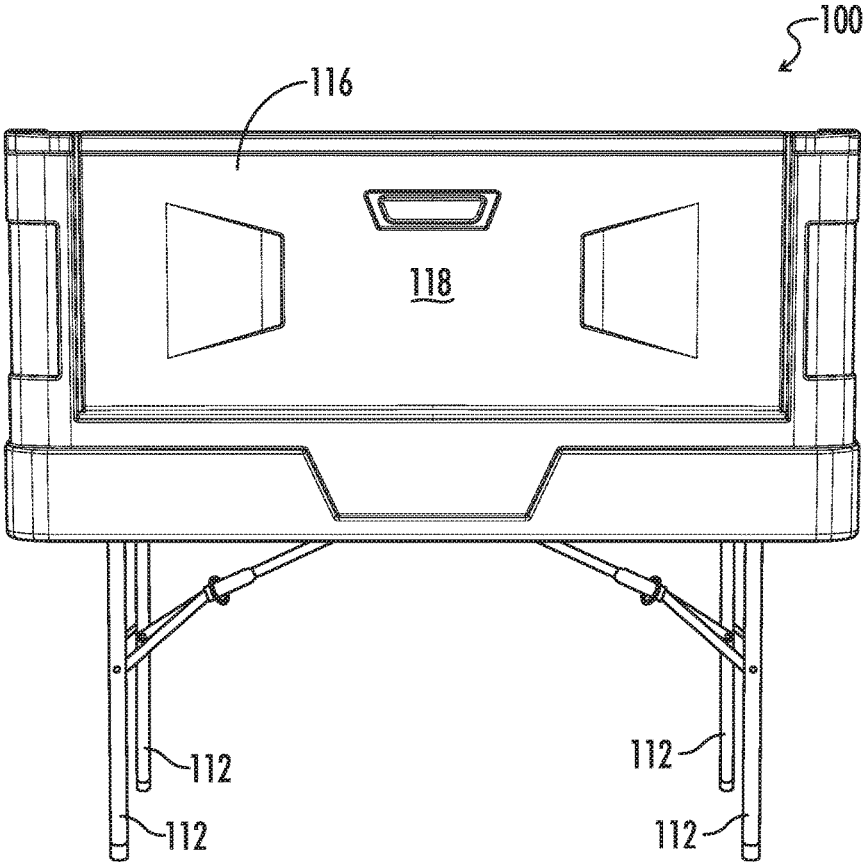
FIG. 3 is a rear elevation view of the table assembly of FIG. 1.
Figure 5:
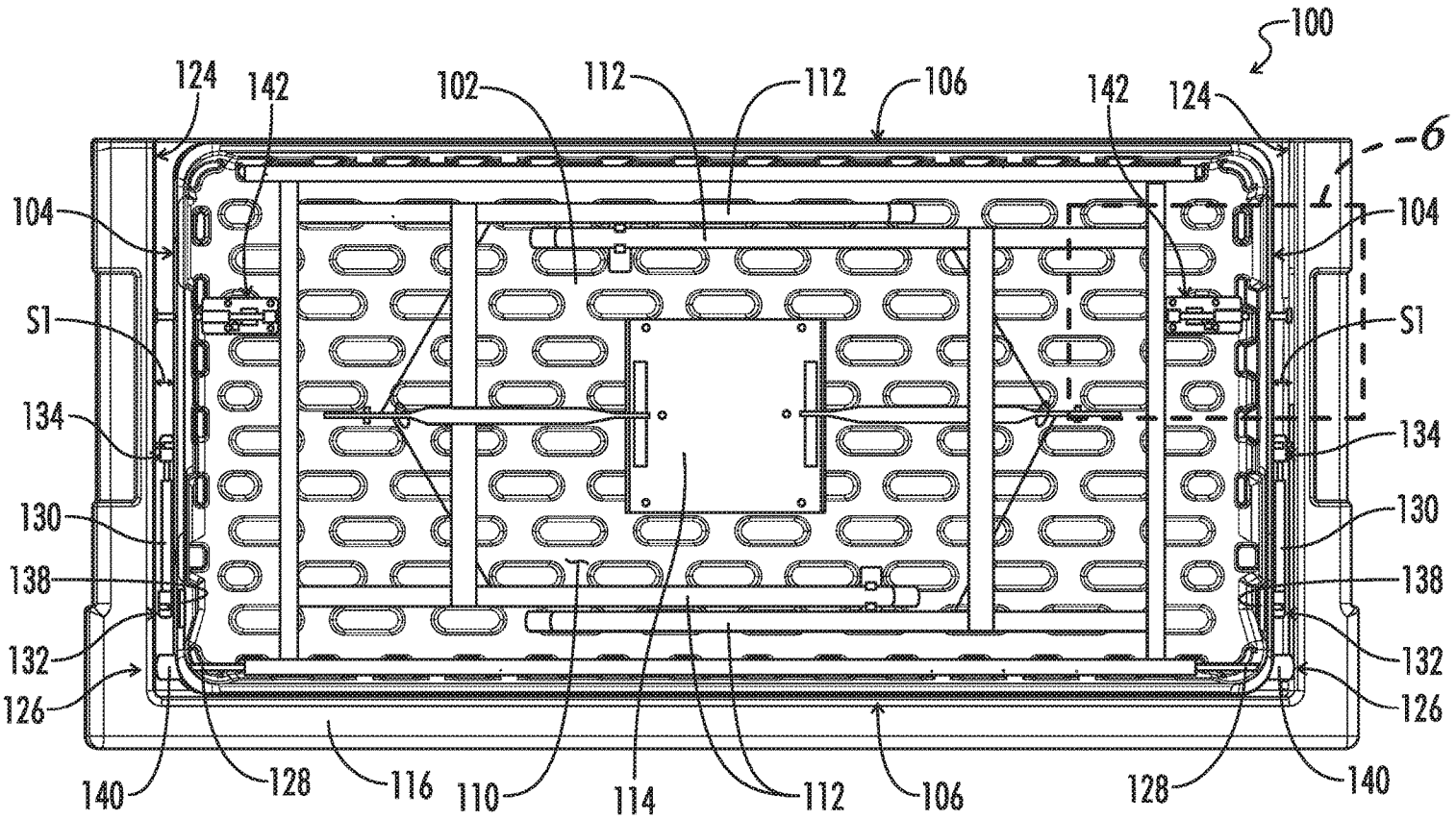
FIG. 5 is a bottom plan view of the table assembly of FIG. 1 with the cover in the closed position and the legs retracted.

A plurality of legs 112 may be connected to the tabletop member 102. In many embodiments, the plurality of legs 112 may be connected to the underside 110 of the tabletop member 102. In some embodiments, the plurality of legs 112 may be connected to one or more of the lateral sidewalls 104 and/or the longitudinal sidewalls 106. The legs 112 may be pivotally attached to the tabletop member 102 such that they may be deployed (as shown in FIGS. 1-3) or retracted (as shown in FIG. 5).

The tabletop member 102 may further include a plate 114 disposed on the underside 110 of the tabletop member. The plate 114 may be configured to provide extra weight to the tabletop member 102 such that the table assembly 100 may resist toppling when in the display position (as shown in FIGS. 1-3). In some embodiments, the plate 114 may further be utilized as an anchor point for connection to portions of the legs 112.

The table assembly 100 may further include a cover 116. The cover 116 may include an outer surface 118, which may resemble a tailgate of a vehicle in some embodiments. The cover 116 may further include an interior surface 120 opposite the outer surface 118. The interior surface may include an indentation, or cover cavity 122 defined therein. The cover cavity 122 may be defined on at least one side by an interior sidewall 124 of the cover 116. In the embodiment shown in FIG. 5, the cover cavity 122 is defined on three sides by interior sidewalls 124 of the cover 116.

The cover 116 may be pivotally connected to the tabletop member 102 about a cover pivot 126. The cover pivot 126 may include any appropriate configuration of hardware, and is shown in the Figures as including a pivot rod 128. Other embodiments may include a hinge joint, a boss and socket connection, a ratcheting connection utilizing one or more detent mechanisms, and the like. The cover 116 may be configured to move from a closed position (shown in FIG. 5) to a display position (shown in FIGS. 1-3). The cover 116 may also be configured to move from the display position back to the closed position. The cover 116 may be further configured to receive at least a portion of the tabletop member 102 in the cover cavity 122 when the cover is in the closed position. In some embodiments, the tabletop member 102 may be surrounded on three sides (that is, the interior sidewalls 124 of the cover 116 may be adjacent two lateral sidewalls 104 and adjacent one longitudinal sidewall 106) when the cover is in the closed position. In many embodiments, the tabletop member 102 may be completely received in the cover cavity 122 such that the tabletop member does not extend beyond the cover 116 in any direction parallel to the plane formed by the top surface 108 of the table top member. In at least one embodiment, the pivoting action of the cover 116 relative to the tabletop member 102 is that of what may be characterized as a modified clamshell configuration. Stated another way, some embodiments may include the longitudinal sidewall 106 of the table top member 102 being at least partially disposed in the cover cavity 122 in both of when the cover 116 is in the closed position and when the cover is in the display position.

Figure 4:
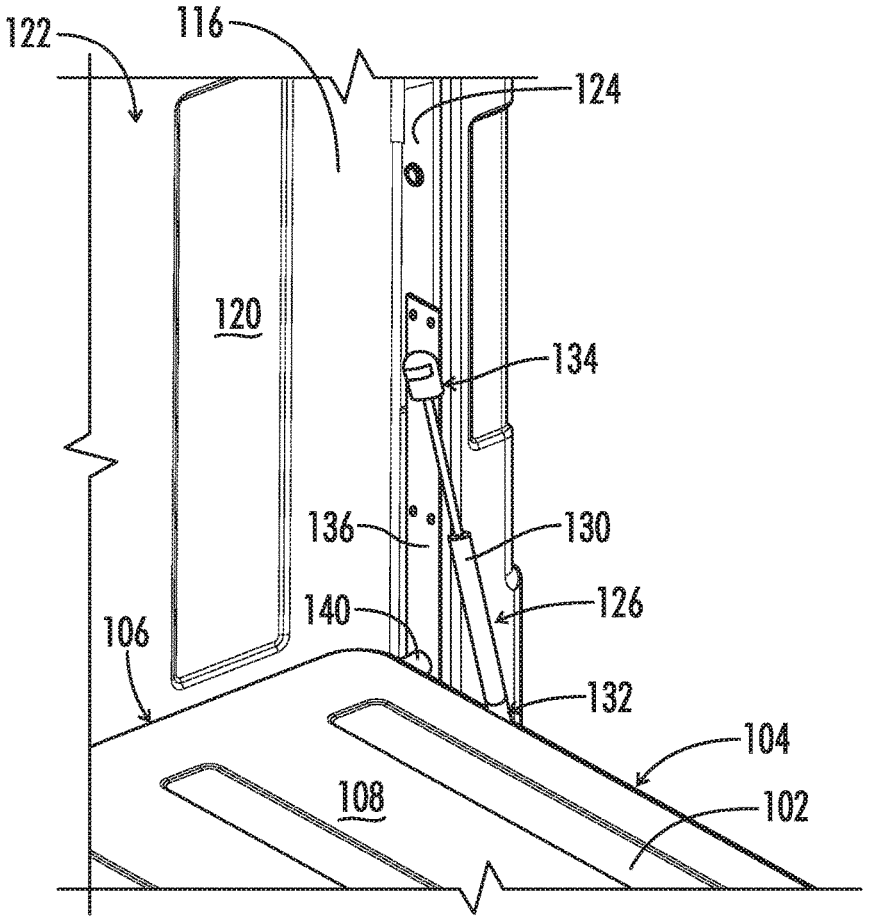
FIG. 4 is a detailed perspective view of the cover pivot and the adjustable length arm of the table assembly of FIG. 1.

As shown particularly in FIG. 4, an adjustable length arm 130 may connect to both the tabletop member 102 and the cover 116. The adjustable length arm 130 may include a first arm end portion 132 and a second arm end portion 134 opposite the first arm end portion. The first arm end portion 132 may be pivotally connected to the lateral sidewall 104 of the tabletop member 102. The second arm end portion 134 may be pivotally connected to the interior sidewall 124 of the cover 116. In these embodiments including the adjustable length arm 130, the cover pivot 126 may be located nearer the longitudinal sidewall 106 of the tabletop member 102 than the first arm end portion 132. Of course, multiple embodiments are considered herein which include one, two, or more adjustable length arms 130 connected to both the table top member 102 and the cover 116.

In some embodiments, the cover 116 may further include a cover support plate 136 disposed on the interior sidewall 124. The first arm end portion 132 may be pivotally connected to the cover support plate 136. This configuration may help prevent tearing or otherwise breaking the material of the cover 116 due to the reinforcing characteristics of the cover support plate 136. The cover support plate 136 may further be configured to receive the pivot rod 128 for similar reasons.

The table assembly 100 may further include the tabletop member 102 including a second arm end portion support plate 138 disposed thereon. The second arm end portion 134 of the adjustable length arm 130 may be pivotally connected to the second arm end portion support plate 138. Similar to the discussion above, the support plate 138 may help prevent tearing or otherwise breaking of the material of the tabletop member 102.

In some embodiments, a spacer 140 may be disposed between the lateral sidewall 104 of the tabletop member 102 and the interior sidewall 124 of the cover 116. The spacer 140 may be configured to maintain a space S1 between the lateral sidewall 104 and the interior sidewall 124. The adjustable length arm 130 may be disposed in the space S1 when the cover 116 is in the closed position (as illustrated in FIG. 5). In many embodiments, the spacer 140 may be disposed about the pivot rod 128.

Figure 6:
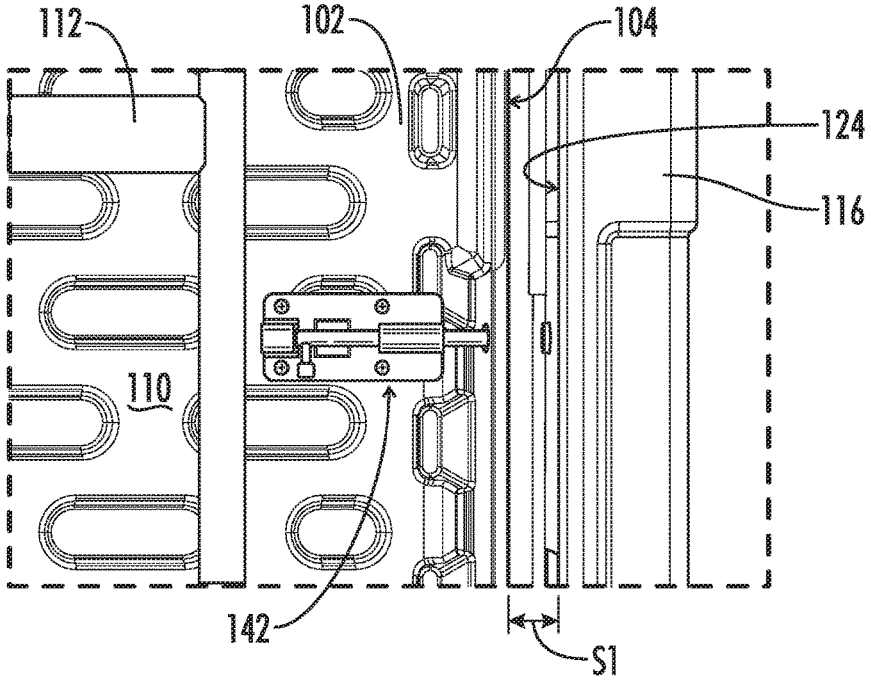
FIG. 6 is a detailed bottom plan view of the lock of the table assembly of FIG. 1.

Many embodiments of the table assembly 100 may further include a lock 142 configured to secure the cover 116 to the tabletop member 102 when the cover is in the closed position (as shown in FIG. 5). The one or more locks 142 may allow a user to more easily transport the table assembly 100 when the table assembly is in the closed position. As such, the lock 142 may hold the tabletop member 102 and the cover 116 proximate to each other when the table assembly 100 is in the closed position. Especially in embodiments including relatively heavy components, the lock 142 may increase safety and convenience for a user in transporting the table assembly 100. The lock 142 may include any appropriate fastener, but is shown as a deadbolt that is configured to extend into the interior sidewall 124 of the cover 116. Many embodiments contemplate any appropriate orientation of the lock 142. The lock 142 may be further configured to extend through the lateral sidewall 104 of the tabletop member 102 in addition to extending into the interior sidewall 124 of the cover 116. Some embodiments may further include support plates (not shown) to reinforce the areas interacting with the lock 142 such that the material of the cover 116 and/or the table top member 102 do not rip or break. The lock 142 that is illustrated in the Figures is shown in a locked position in FIG. 5 and in an unlocked position in FIG. 6.

Thus, the features of the table assembly 100 may facilitate, in some embodiments, a three dimensional representation of a tailgate while still providing a useable table surface 108. The otherwise unequal distribution of weight caused by the right angle, or L position, of the table assembly 100 when the cover 116 is in the display position is counteracted by sufficient weight on or in the tabletop member 102. Many embodiments of the table assembly 100 may allow for the appearance of a tailgate in both the closed position (FIG. 5) and the display position (FIGS. 1-3).

With a table assembly 100 that resembles a tailgate, the look and feel of stadium tailgating (even with no vehicles nearby) may be satisfactorily achieved. Of course, the current disclosure need not be interpreted to be limited solely to a table. For instance, chairs may be contemplated that are simply shorter and narrower than the table assembly 100 shown. The chairs may, in some instances, be considered part of a set or kit with the table assembly 100 and may closely resemble the table assembly.

The table assembly 100 may also include a folding mechanism that may exhibit an automatic opening once a threshold opening amount of the cover 116 toward the display position has been achieved. The automatic opening may be accomplished by gravity, springs, gears, hydraulic or pneumatic actuators, any combination thereof, and the like.

Many embodiments of the table assembly 100 may further include sufficiently flat surfaces configured to allow a user to affix stickers having desired indicia thereon. Sports logos and colors may be used, for instance.

Although the illustrated embodiment includes a polymer tabletop member 102 and cover 116 with metal legs, any appropriate materials are contemplated herein.

Thus, a free standing folding table assembly 100 has been described that, in at least some embodiments, may represent a tailgate.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

What is claimed is:

1. A table assembly comprising:

a table top member including:

first and second opposing lateral sidewalls; and first and second opposing longitudinal sidewalls;

a pivot rod extending through respective apertures in the first and second lateral sidewalls to define a cover pivot;

a cover including a cover cavity having first and second opposed interior sidewalls, each of the first and second interior sidewalls further comprising respective first and second cover support plates configured to receive the pivot rod, wherein the cover is pivotally connected to the table top member about the cover pivot, the cover configured to move from a closed position to a display position;

first and second adjustable length arms that are adjustable in length during movement of the cover between the closed position to the display position, each adjustable length arm including a first arm end portion and a second arm end portion, wherein each first arm end portion is pivotally connected at a single point to the respective lateral sidewall of the table top member, and each second arm end portion is pivotally connected at a single point to the respective cover support plate; and wherein:

the cover is configured to receive the table top member in the cover cavity when the cover is in the closed position; and the cover pivot is located nearer the longitudinal sidewall of the table top member than the first arm end portion.

2. The table assembly of claim 1, further including:

a spacer disposed between the lateral sidewall of the table top member and the interior sidewall of the cover, the spacer configured to maintain a space between the lateral sidewall and the interior sidewall; and wherein the adjustable length arm is disposed in the space when the cover is in the closed position.

3. The table assembly of claim 2, wherein the spacer is disposed about the pivot rod.

4. The table assembly of claim 1, wherein:

the first and second opposing lateral sidewalls of the tabletop member further comprise respective first and second adjustable length arm end portion support plates; and the respective first arm end portions are pivotally connected to the first and second adjustable length arm end portion support plates.

5. The table assembly of claim 1, further comprising a lock configured to secure the cover to the tabletop member when the cover is in the closed position.

6. The table assembly of claim 5, wherein the lock includes a deadbolt configured to extend into the interior sidewall of the cover.

7. The table assembly of claim 6, wherein the deadbolt is further configured to extend through the lateral sidewall of the tabletop member.

8. The table assembly of claim 1, wherein the longitudinal sidewall of the tabletop member is disposed in the cover cavity both when the cover is in the closed position and when the cover is in the display position.

9. The table assembly of claim 1, wherein the tabletop member further includes:

a tabletop member underside facing away from the cover member when the cover member is in the closed position; and a plate disposed on the tabletop member underside, wherein the plate configured is to provide extra weight to the tabletop member such that the table assembly resists toppling at least when the cover is in the display position.

10. The table assembly of claim 1, wherein a majority of the cover is disposed above the tabletop member when the table assembly is in the display position.

11. The table assembly of claim 10, wherein the cover extends a length above the tabletop member that is greater than or equal to the width of the tabletop member when the table assembly is in the display position.

* * * * *